United States Patent [19]

Brandifino et al.

[11] 4,028,826

[45] June 14, 1977

[54] PERPETUAL MEMORY BANK CALENDAR

[76] Inventors: Angelo Brandifino; Frances Brandifino, both of 10 Sheridan St., Huntington, N.Y. 11743

[22] Filed: Mar. 15, 1976

[21] Appl. No.: 666,863

[52] U.S. Cl. ..... 40/110; 40/118
[51] Int. Cl.[2] ..... G09D 3/00
[58] Field of Search .... 40/107, 109, 110, 116–122; 35/7 R, 62; 283/2

[56] References Cited

UNITED STATES PATENTS

| | | | |
|---|---|---|---|
| 871,310 | 11/1907 | Wade | 40/110 |
| 1,190,967 | 7/1916 | Stacy | 40/110 |
| 2,564,846 | 8/1951 | Hughes | 40/110 |
| 2,831,278 | 4/1958 | Myers | 40/107 |
| 3,421,239 | 1/1969 | Smith | 40/63 R |
| 3,473,249 | 10/1969 | Ankrum | 40/107 X |
| 3,579,883 | 5/1971 | Hayes | 40/107 |
| 3,696,532 | 10/1972 | Nahon | 35/7 R |
| 3,911,606 | 10/1975 | Hunkins | 40/110 |

FOREIGN PATENTS OR APPLICATIONS

| | | | |
|---|---|---|---|
| 1,065,172 | 12/1953 | France | 40/117 |

*Primary Examiner*—John F. Pitrelli
*Attorney, Agent, or Firm*—Richard L. Miller

[57] ABSTRACT

A perpetual calendar which additionally serves as a memory bank by recording personally important dates, such as family member birthdays and appointments; the device including a frame around a window behind which different month cards are selectively positioned for viewing during a current month, each month card including a memorandum space where important dates of the month are recorded, the memorandum space being erasable, different colored stickers being mounted adjacent each entry written in the memorandum space, and each being a same color as another sticker being mounted over the date on the calender, and an endless belt over the month card being imprinted with the names of the days of the week, the belt being movable so to selectively align with the specific numerical arrangement of dates on each month card.

1 Claim, 8 Drawing Figures

PERPETUAL MEMORY BANK CALENDAR

This invention relates generally to perpetual caldendars.

A principal object of the present invention is to provide a perpetual calendar that additional serves as a memory bank by reminding personally important dates to an individual, such as family birthdays and appointments.

Another object is to provide a perpetual memory bank calendar that includes only six interchangeable month cards printed wih a different month of each face, the card faces being selectively placed behind a window for viewing.

Still another object is to provide a perpetual memory bank calendar having an adjustable belt on which the days of the week are imprinted, the belt being adjustable to the printed calendar month cards so that the dates of each month are properly aligned with the days of a week.

Other objects are to provide a perpetual memory bank clendar which is simple in design, inexpensive to manufacture, rugged in construction, easy to use and efficient in operation.

Further objects of the invention will appear as the description proceeds.

To the accomplishment of the above and related objects, this invention may be embodied in the form illustrated in the accompanying drawings, attention being called to the fact, however, that the drawings are illustrated only, and that changes may be made in the specific construction illustrated and described within the scope of the appended claims.

Figure 1:
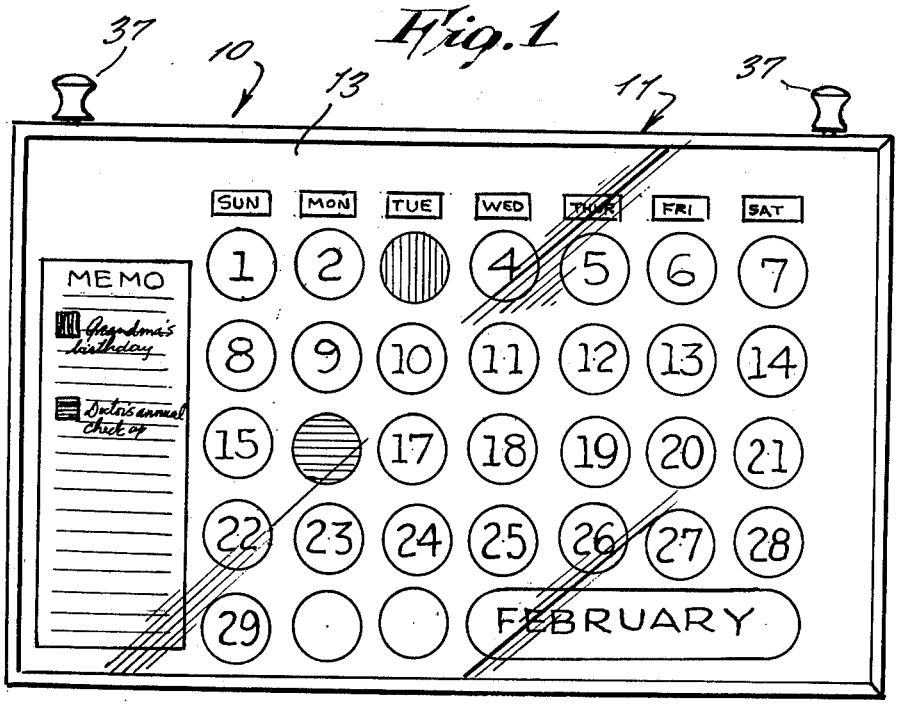
FIG. 1 is a front elevational view of the device.
Figure 2:
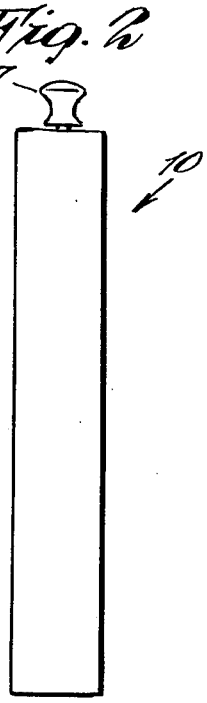
FIG. 2 is a side view.
Figure 3:
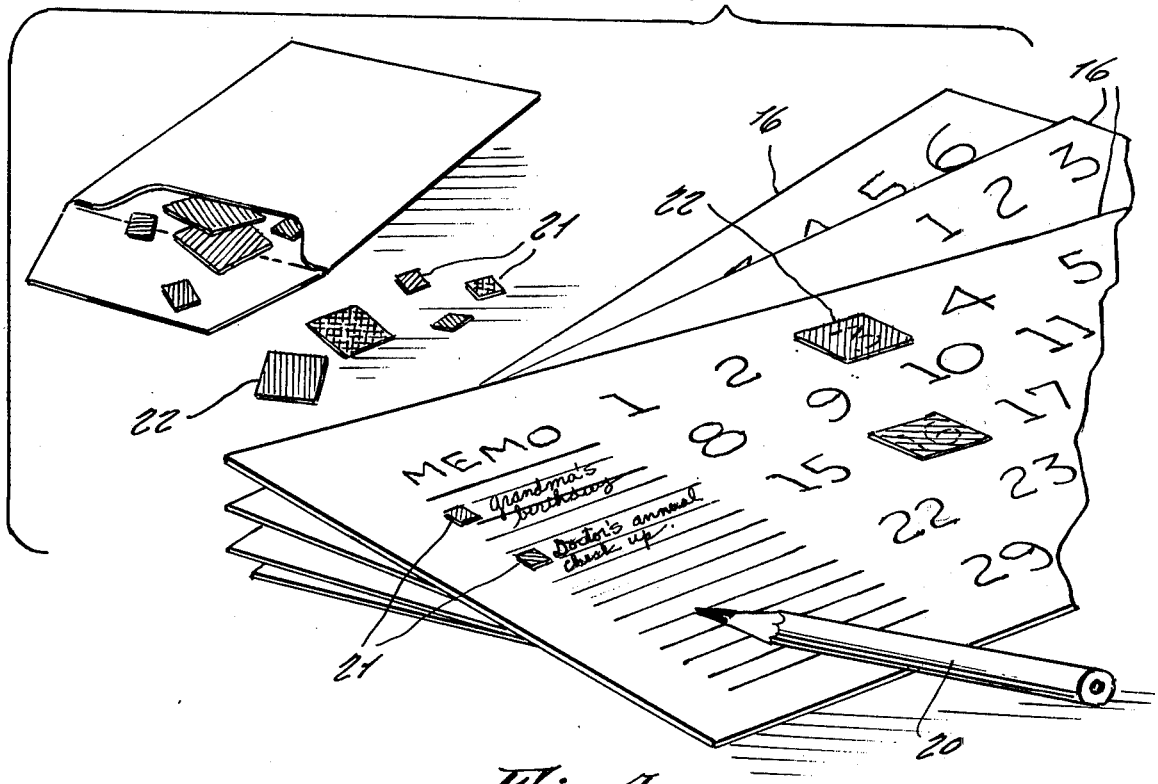
FIG. 3 illustrates the recording of events on each month card and the use of stickers to relate event entries with the month dates.
Figure 4:
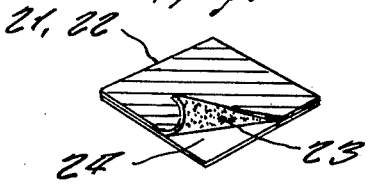
FIG. 4 illustrates a typical sticker construction.
Figures 5, 6, 7, 8:
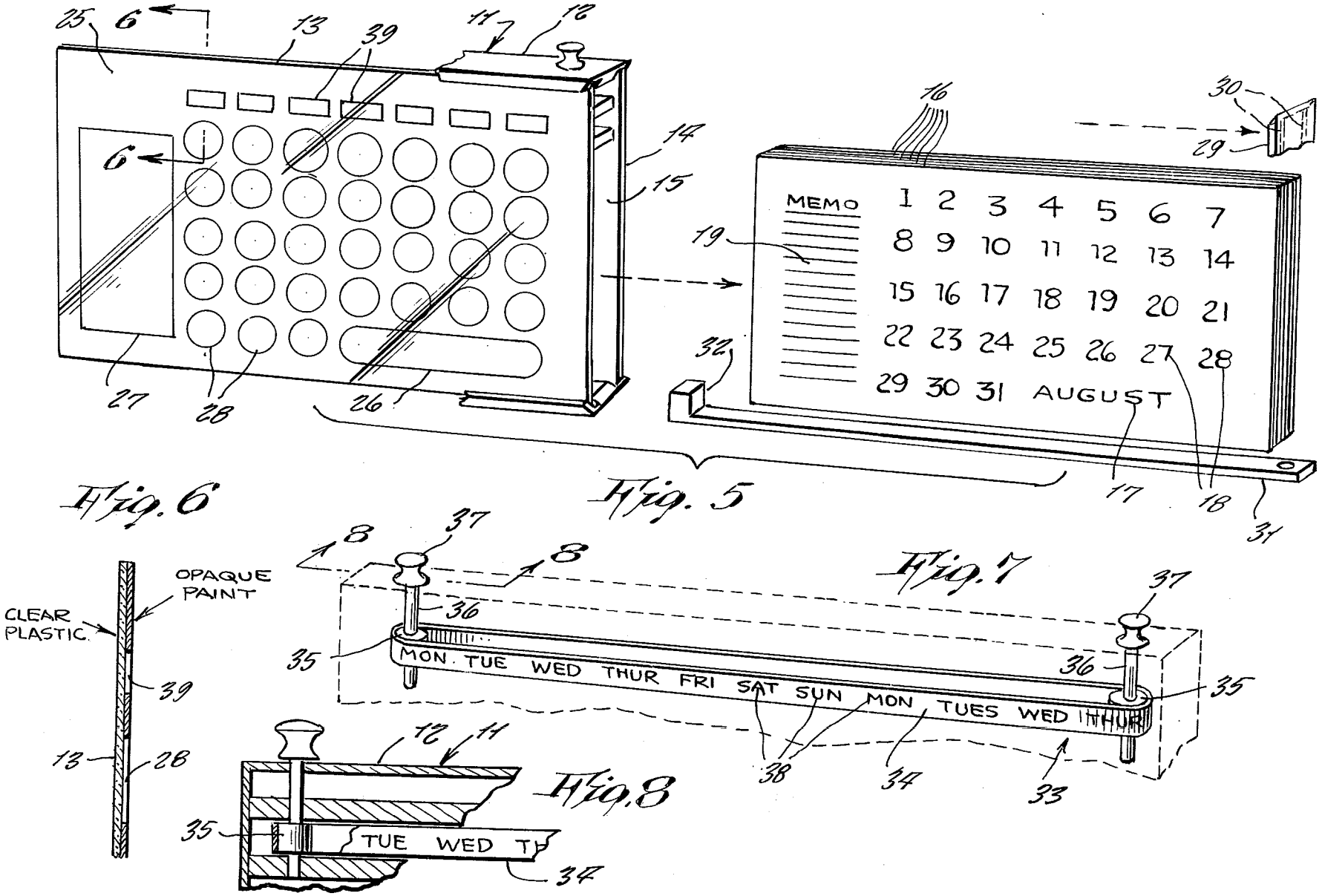
FIG. 5 is a fragmentary view of the case and removable month cards.
FIG. 6 is a cross section taken on line 6—6 of FIG. 5.
FIG. 7 is a perspective view of the day name adjustment mechanism.
FIG. 8 is a cross sectional view taken on line 8—8 of FIG. 7.

Referring now to the drawings in detail, the reference numeral 10 represents a perpetual memory bank calendar according to the present invention wherein there is a case 11 consisting of a rectangular frame 12 fitted with front window 3 and rear panel 14 that enclose a chamber 15 for containing six month cards 16, each of which is imprinted on each side with a name of a different month 17 and the numerical dates 18 for the particular month. Thus January is imprinted with 31 dates, February with 29 (including the leap year day), etc. The dates are imprinted in rows of seven dates each; each month having numerals 1 to 7 in the first row, 8 to 14 in the second row, 15 to 21 in the third row, 22 to 28 in the fourth row, and the remaining numerals on the fifth row.

Each month card has a memorandum space 19 imprinted on each side and in which a person may write, with an erasable marker 20, any event that he wishes to record so to serve as a reminder during the particular month. Supplied with the calendar 10, there are small sized stickers 21 of different colors for being adhered adjacent each entry on the memorandum space, and correspondingly same colored large stickers 22 are mountable over the particular date 18 to which the memorandum entry relates so that the event recording is readily noticed. Each sticker has a pressure sensitive adhesive 23 on its rear, protected by a peelable paper 24 prior to use. The surfaces of the month cards are glazed so that the stickers can be peeled off afterwards without damage, and the surface can erased of any entries written with marker 20. Thus the surface is always kept fresh for future entries and adhering stickers.

The window 13 made of clear plastic, has opaque paint applied to its inner side so to define opaque area 25 and clear area 26 for the month name 17, clear area 27 for the memorandum space 19 and clear areas 28 for each numeral date 18.

One side frame member 29 is readily removable for providing access to the interior chamber 15 in order to relocate the proper month card behind the window 13 each month time. The member 29 snap fits into the frame by having grooves 30 that receive the edges of the window 13 and rear panel 14.

A pull bar 31, normally stored inside the chamber 15 has a hook 32 on its end for conveniently pulling out the month cards 16 outward of the chamber.

Within the case, a mechanism 33 includes an endless belt 34 passed around rollers 35 secured on shaft 36 extending outwardly from the top of the case and integral with external knobs 37 so to be manually rotatable. The names 38 on the different days of a week are imprinted on the belt so to be visible in clear areas 39 of the window 13. It will now be apparent that the correct day names 38 can be readily adjusted in the calender 10 so to suit the numerical dates 18 fixed imprinted on the cards 16, so that any month can be quickly and easily set up correctly, thus making the calendar of perpetual type.

Thus there is provided a useful perpetual memory bank calendar.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A perpetual memory bank calendar, comprising in combination, a case consisting of a frame fitted with front window and rear panel enclosing a central chamber containing removable six month cards each having a name of a different month imprinted on each side thereof, said month card sides being selectively placable in said chamber to face said window, wherein each said month card side additionally includes imprinted thereupon the numerical dates of said month, arranged in rows, each said month card side additionally includes a memorandum space for being written upon by an erasable marker, a surface of each said month card side being glazed, wherein a mechanism inside said case includes an endless belt having names of the days of a week imprinted thereupon, said belt being movable for alignment of said day names respective to said numerical dates on said month card sides wherein different colored stickers of self adhesive type are mounted upon said month card sides and corresponding to stickers on said memorandum space and over said numerical dates.

* * * * *